United States Patent [19]

Lemmer

[11] Patent Number: 4,577,174

[45] Date of Patent: Mar. 18, 1986

[54] ELECTROMAGNET FOR ELECTRIC SWITCHING DEVICE

[75] Inventor: Helmut Lemmer, Marienheide-Kalsbach, Fed. Rep. of Germany

[73] Assignee: Square D Starkstrom GmbH, Marienheide, Fed. Rep. of Germany

[21] Appl. No.: 709,788

[22] Filed: Mar. 11, 1985

[30] Foreign Application Priority Data

Mar. 31, 1984 [EP] European Pat. Off. ..... 84103594.2
Oct. 25, 1984 [EP] European Pat. Off. ..... 84112847.3

[51] Int. Cl.[4] ..... H01F 7/08
[52] U.S. Cl. ..... 335/261; 335/245; 335/279
[58] Field of Search ..... 335/131, 245, 255, 261, 335/279, 281

[56] References Cited

U.S. PATENT DOCUMENTS 984,748 2/1911 Coleman ..... 335/245 X
2,378,162 6/1945 Stapleton ..... 335/131

FOREIGN PATENT DOCUMENTS 0005734 12/1979 European Pat. Off. ..... 335/281
1810250 11/1969 Fed. Rep. of Germany ..... 335/281
1557435 1/1969 France ..... 335/281
392449 5/1933 United Kingdom ..... 335/245

*Primary Examiner*—George Harris
*Attorney, Agent, or Firm*—Michael J. Striker

[57] ABSTRACT

In an electromagnet for an electric switch, particularly safety switch, an armature and a magnetic core are each formed of a pack of laminations connected to each other by rivets. The laminations of the armature and the magnetic core are equally shaped and formed so that the pack of laminations of the armature matches the pack of laminations of the core in assembly.

6 Claims, 14 Drawing Figures

ELECTROMAGNET FOR ELECTRIC SWITCHING DEVICE

BACKGROUND OF THE INVENTION

The present invention relates to an electromagnet for an electric switching device, particularly safety switch or circuit breaker, which includes a movable armature and a magnetic core.

Armatures and magnetic cores of the electromagnets of safety switches are formed of laminations assembled into packs and connected to each other by rivets.

Electromagnets of the foregoing type are usually utilized in mass production for switching devices of various types. Various switching devices require, depending on their structure, size and output, different electromagnets. However efforts have been made to standardize such electromagnets.

The manufacture of electromagnets for electric switches is usually very expensive because special cutting tools or punching tools are required for making armatures, on the one hand, and magnetic cores, on the other hand. Furthermore, huge storage spaces are required for storing tools for making electromagnets of various sizes and constructions. Furthermore, rivets utilized for holding laminations in a pack have been differently positioned for the armature and the magnetic core so that different riveting stations have been required for manufacturing armatures and magnetic cores.

SUMMARY OF THE INVENTION

It is an object of the present invention to provide an improved electromagnet for electric switches, particularly safety switches.

It is another object of this invention to provide an electromagnet which is easy to manufacture automatically and which is inexpensive to make.

These and other objects of the invention are attained by an electromagnet for an electromagnetic switching device, particularly safety switch, comprising a magnetic core and a movable armature, said core and said armature being each formed of a plurality of superposed laminations assembled into a pack and connected to each other by rivets, said core and said armature being each assembled of evenly-shaped laminations.

Due to the invention, instead of conventional four cutting or punching tools and respective machines, only two cutting or punching tools are required.

If the electromagnet is utilized for alternating current the armature and the core each may include two outer legs and one central leg, each outer leg being formed with a widened portion extending towards the central leg, at least the widened portion of one outer leg having an end face formed with grooves for receiving therein a short circuit ring.

If the electromagnet is utilized for direct current, one of the outer legs may have at its free end an oblique surface which merges into a flat end face, the other of the outer legs having a free end formed with another oblique surface and with a flat stop surface, said another oblique surface and the stop surface fit said first mentioned oblique surface and said end face, respectively when the armature is laid over the magnetic core, said central leg having a further oblique surface such that an air gap results between the further oblique surface of the central leg of the core and the further oblique surface of the central leg of the armature when the latter and the core are in assembly.

Each pack may be provided with holes for said rivets, and positions of said holes and said rivets in each pack may be selected so that these positions be the same for all armatures and magnetic cores of electromagnets operated with alternating current or with direct current. A further advantage of this invention resides in the fact that instead of four riveting tools or riveting machines, required in conventional method of manufacture of electromagnets, only a single riveting tool or riveting machine is now required.

The laminations may be punched out to have a profile so that a mechanical after treatment of said laminations would be omitted.

The central leg may have two trapezoidal projections having outer inclined surfaces and an intermediate inclined surface which form said further oblique surface, the sum of the lengths of said outer inclined surfaces being equal to the length of said intermediate inclined surface.

One of said outer legs may have at said end a trapezoidal recess defined by two symmetrically extending oblique surfaces, and another of said outer legs may have at the end thereof a trapezoidal projection which matches said recess.

One of said outer legs may have at said recess two end faces and another of said outer legs may have at said projection two stop surfaces.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
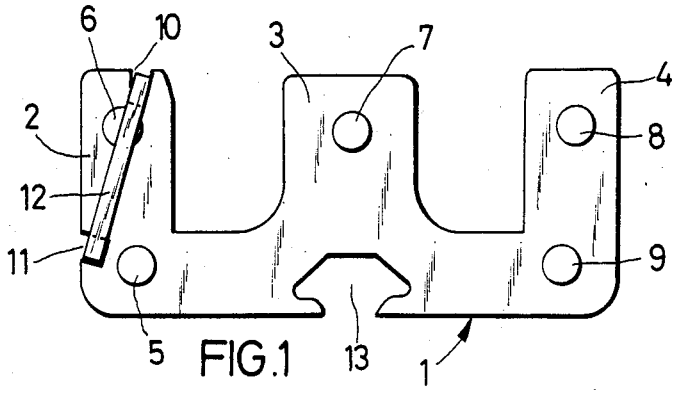
FIG. 1 is a front view of an alternating current magnetic core.
Figure 3:
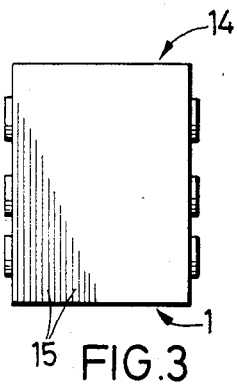
FIG. 3 is a side view of the electromagnet of FIG. 2.
Figure 2:
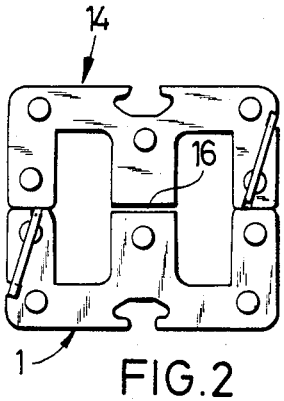
FIG. 2 is a front view of an electromagnet in which the armature and the magnetic core have the same construction.

Referring now to the drawings in detail, and first to FIGS. 1–3 thereof, these figures illustrate an electromagnet for alternating current, in which a magnetic core 1 and an armature 14 are fully identical. This is clearly seen from FIG. 2. The magnetic core 1 and armature 14 accordingly each has three legs 2, 3 and 4 extended outwardly from the base and being parallel to each other. The core 1 and armature 14 each is comprised of a package of superposed laminations 15. The thickness of the package can vary, however the same cutting tools and riveting tools can be used to produce the core or the armature. Laminations 15 are connected to each other in a pack by means of rivets 5, 6, 7, 8 and 9; it is therefore important that the positions of holes for rivets and correspondingly, of rivets for the armature and the core be selected at the same places. Grooves 10 and 11 are punched in the leg 2. A short-circuit ring 12 is inserted into grooves 10 and 11. FIG. 2 clearly illustrates by the position of the short-circuit ring 12 that magnetic core 1 and armature 14 of the same shape are pivotable relative to each other.

A recess 13 serves, in case of the magnetic core, for connecting the core with a housing of a switching device or any other stationary element whereas, in case of an armature, this recess serves for connecting to a movable member of the switching device. As seen from FIG. 2 an air gap remain between two middle legs 3 of magnetic core 1 and armature 14.

Figure 4:
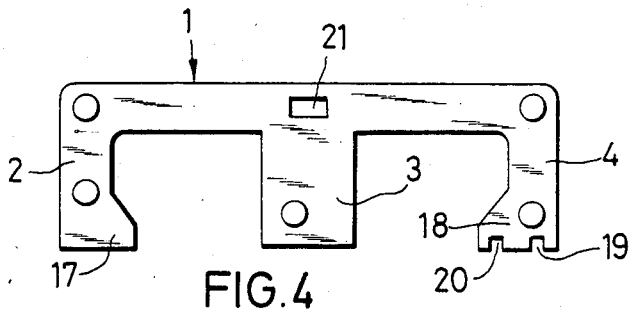
FIG. 4 is a front view of an alternating current magnetic core of another embodiment.
Figure 5:
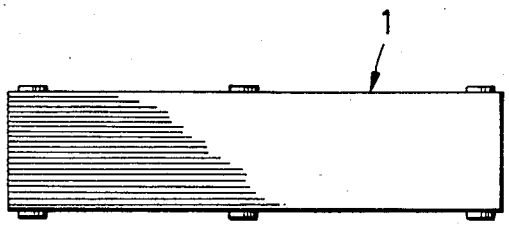
FIG. 5 is a top plan view of FIG. 4.

With reference to FIGS. 4 and 5, which show a further embodiment of the electromagnet for a circuit breaker, it will be seen that in this embodiment the structure of the core and the armature substantially coincides with that of FIGS. 1–3. Portions of the structural components in FIGS. 4 and 5, similar to those of FIGS. 1–3, are denoted by like reference numerals. The armature and the magnetic core each also has three legs 2, 3 and 4. Outer legs 2 and 4 have each an inwardly projecting widened portion 17, 18. Grooves 19 and 20 are formed in a lower end face of widened portion 18. Grooves 19 and 20 receive a non-shown short-circuit ring similarly to the embodiment of FIGS. 1–3. Instead of recess 13 an opening 21 is punched in the pack of laminations of the armature and the core, opening 21 extending normally to the plane of the drawing. Opening 21 receives a connecting pin or any other suitable connecting element.

Figure 6:
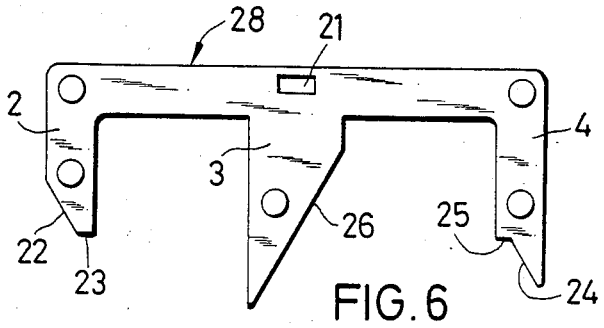
FIG. 6 is a front view of a direct current magnetic core.
Figure 7:
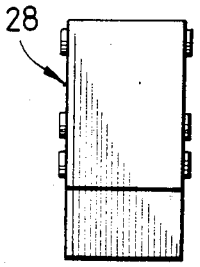
FIG. 7 is a side view of FIG. 6.
Figure 8:
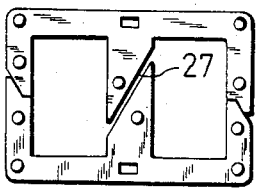
FIG. 8 is a front view of an electromagnet for direct current, in which the armature and magnetic core are similarly formed in accordance with FIG. 6.

FIGS. 6 through 8 show yet another embodiment of the electromagnet in which the structures of the core and the armature are identical. The magnetic core or the armature is designated by reference numeral 28. Each includes three legs 2, 3 and 4. An inclined surface 22 is provided on the outer leg 2. Surface 22 merges into a small horizontal end face 23. Another inclined surface 25, merging into a horizontal stop 25, is provided on another outer leg 4. As shown in FIG. 8, inclined surfaces 22 and 24, as well as end faces 23 and stops 25, are shaped and dimensioned such that in assembly the armature fits the magnetic core. As seen from FIG. 8 both elements are pivotable one relative to another by 180° once about a horizontal axis and once about a vertical axis. The middle leg 3 also has an inclined surface 26 which is punched out during manufacturing of laminations. Inclined surface 26 is formed such that an air gap 27 remains between respective surfaces 26 of the armature and the magnetic core when the latter are in superimposed position.

Figure 9:
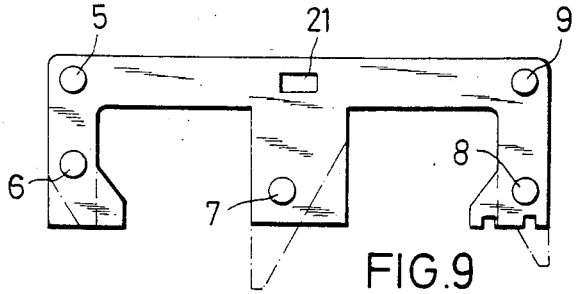
FIG. 9 is a front view of a drill template for the armature and the core to be used for alternating current magnets and direct current magnets as well.

FIG. 9 shows the template with the positions of holes for rivets as well as of rivets so selected that they can be the same for all armatures and magnetic cores of alternating current magnets and direct current magnets. In FIG. 9 the alternating current core and the direct current core are positioned one on the other. The alternating current core corresponds to that of the embodiment of FIGS. 4 and 5. The direct current magnetic core in FIG. 9 corresponds to that of FIG. 6. Inasmuch as the armature and the magnetic core have the same structure the same positions of openings for rivets for all armatures and cores result so that only a single riveting tool or a single riveting machine is required for producing said openings.

Figure 10:
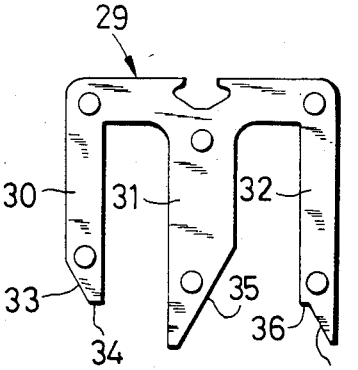
FIG. 10 is a front view of yet another embodiment of an alternating current magnetic core.
Figure 11:
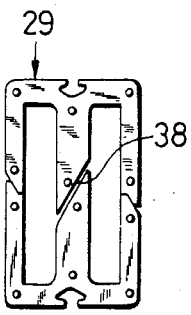
FIG. 11 is a front view of an electromagnet in which the armature and the core are alike and formed in accordance with FIG. 10.
Figure 12:
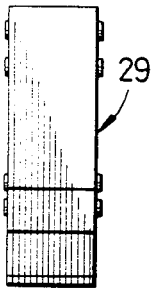
FIG. 12 is a side view of FIG. 10.

FIGS. 10 through 12 depict yet another embodiment in which the direct current core or armature is denoted by reference numeral 29. The armature or magnetic core has three legs 30, 31 and 32 which are substantially longer when a large coil is required. Inclined surfaces 33 and 37 and the end face 34 and stop 36 are formed in the same fashion as similar surfaces in FIG. 6. In the same manner the middle leg 31 has an inclined surface 35. An air gap 38 is formed between oposing inclined surfaces 35 when the armature and magnetic core are in assembled position as shown in FIG. 12.

Advantageously, laminations or sheets 15 are punched out into a whole profile so that a mechanical aftertreatment, particularly of opposing surfaces of the armature and the core, could be omitted.

Figure 13:
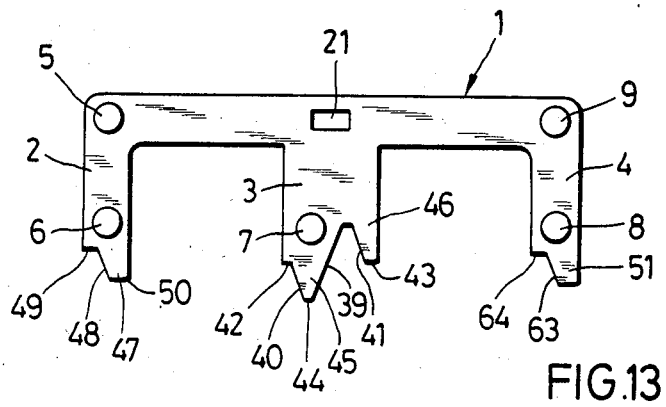
FIG. 13 is a front view of still further modification of a direct current core or armature.

FIG. 13 shows a further embodiment of the armature or the magnetic core for direct current electromagnets, in which similar reference numerals are utilized for the components mentioned in connection with the previously described embodiments. In this embodiment the middle leg 3 has two triangular or trapezoidal projections 45 and 46, which are dimensioned so that the sum of the lengths of the outer inclined surfaces 40 and 41 of these projections is equal to the length of an intermediate inclined surface 39. Inclined surfaces 39, 40 and 41 preferably extend at an angle 20° relative to the direction of movement of the armature, but always at an acute angle. In this fashion a very large effective magnetic surface in comparison with the size of the armature or the core results, which is particularly advantageous with three-dimensional small direct current circuit breakers. A small stop 42 is provided on the middle leg 3 laterally of projection 45. The trapezoidal shape of each projection 45, 46 results in flat horizontal end faces 43 and 44. The entire shape of middle leg 3 with the above described surfaces ensures that during the assembly of the armature with the magnetic core a small uniform air gap will result between the respective opposing surfaces. Due to such structure of the middle leg 3 it is obtained that a pulling or magnetic force of the electromagnet would act precisely in the middle axis, that is in the direction of movement of the armature. Thereby the armature during its stroke would be provided with a satisfactory central guidance and friction of the movable parts, particularly the armature relative to walls or guiding surfaces, would be reduced to minimal values. Both outer legs 2 and 4 have trapezoidal projections 47 and 51 with respective inclined surfaces 48 and 63 and horizontal end faces 50. Inclined surfaces 48 and 63 extend at an angle of preferably 20° to the direction of movement of the armature. Stops 49 and 64 are respectively provided laterally of projections 47 and 51.

Figure 14:
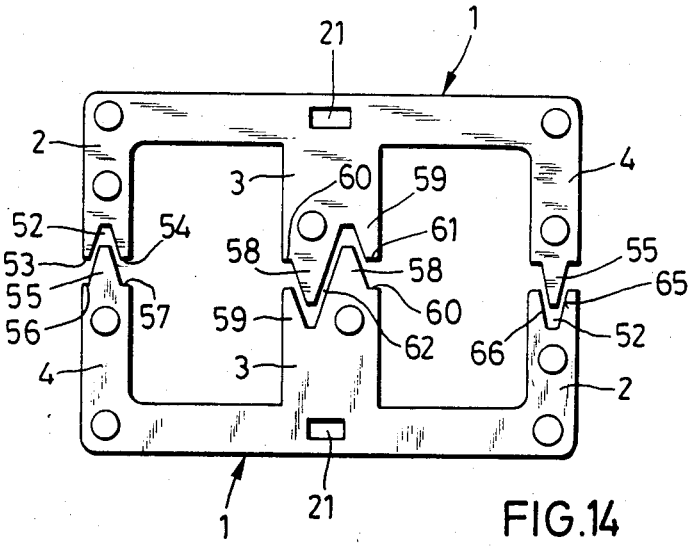
FIG. 14 is a front view of a further embodiment of an electromagnet for direct currrent.

FIG. 14 illustrates yet a further embodiment of the direct current electromagnet with the identically shaped armature and magnetic core. The middle leg of the armature or core is shaped similarly to that of FIG. 13 so that this embodiment has the same advantages as the structure of FIG. 13. Projection 58 here is somewhat triangular while projection 59 is of trapezoidal shape. A stop 60 is provided laterally of projection 58 and a small end face 61 is formed on projection 58. A zigzag-shaped air gap 62 results between the respective opposing surfaces of the armature and the core in assembly. In FIG. 14 this air gap is shown enlarged; in other words the armature and the core are not in their end position but are rather spaced from each other.

In the embodiment of FIG. 14, a trapezoidal recess 52 is provided in one outer leg of the armature or the core. This recess has two symmetrically inclined surfaces 65 and 66. Another outer leg of the armature or the core has in turn a trapezoidally-shaped projection 55 which fits into recess 52 of the opposite leg of the armature or the core, respectively. Inclined surfaces 65 and 66 of recess 52 and the respective surfaces of projection 55 advantageously extend at an acute angle, preferably 20° to the direction of movement of the armature. Laterally of projection 55 are stop surfaces 56 and 57 while laterally of recess 52 small end faces 53 and 54 are formed. Since the above described oblique surfaces on outer legs 2 and 4 are symmetrically shaped no force components in the direction transversal to the direction of movement of the armature would act in the region of the outer legs in case of large effective magnetic surfaces so that a central guidance of the armature would be improved but friction would be reduced.

The armature and the magnetic core have in the exemplified embodiment three legs. However, it is understandable that the invention is applicable to electromagnets having armatures and cores with two legs.

It will be understood that each of the elements described above, or two or more together, may also find a useful application in other types of electromagnets for electric switches differing from the types described above.

While the invention has been illustrated and described as embodied in an electromagnet for an electric switch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electromagnet for an electromagnetic switching device, particularly safety switch, utilized for direct current and comprising a magnetic core and a movable armature, said core and said armature being each formed of a plurality of superposed laminations assembled into a pack and connected to each other by rivets, said core and said armature being each assembled of evenly shaped laminations, said armature and said core each having two outer legs and one central leg, one of the outer legs having a free end and being formed with an oblique surface which merges into a flat end face, the other of the other legs having a free end formed with another oblique surface and with a flat stop surface, said another oblique surface and the stop surface fitting said first mentioned oblique surface and said end face, respectively, when the armature is laid over the magnetic core, said central leg having a further oblique surface such that an air gap results between the further oblique surface of the central leg of the core and the further oblique surface of the cnetral leg of the armature when the latter and the core are in assembly.

2. The electromagnet as defined in claim 1, wherein each pack is provided with holes for said rivets, and wherein holes for said position of said holes and said rivets in each pack are selected so that these positions are the same for all armatures and magnetic cores of electromagnets operated with direct current.

3. The electromagnet as defined in claim 1, wherein said laminations are punched out to have a profile so that a mechanical aftertreatment of said laminations is omitted.

4. The electromagnet as defined in claim 1, wherein said central leg has two trapezoidal projections having outer inclined surfaces and an intermediate inclined surface which form said further oblique surface, the sum of the lengths of said outer inclined surfaces being equal to the length of said intermediate inclined surface.

5. The electromagnet as defined in claim 4, wherein one of said outer legs has at said end a trapezoidal recess defined by two symmetrically extending oblique surfaces and another of said outer legs has at the end thereof a trapezoidal projection which matches said recess.

6. The electromagnet as defined in claim 5, wherein one of said outer legs has at said recess two end faces and another of said outer legs has at said projection two stop surfaces.

* * * * *